US011149551B2

(12) United States Patent
Teramoto et al.

(10) Patent No.: US 11,149,551 B2
(45) Date of Patent: Oct. 19, 2021

(54) PROPELLER FAN

(71) Applicant: Mitsubishi Electric Corporation, Tokyo (JP)

(72) Inventors: Takuya Teramoto, Tokyo (JP); Takashi Ikeda, Tokyo (JP); Yusuke Adachi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 116 days.

(21) Appl. No.: 16/489,721

(22) PCT Filed: Apr. 28, 2017

(86) PCT No.: PCT/JP2017/016878
§ 371 (c)(1),
(2) Date: Aug. 29, 2019

(87) PCT Pub. No.: WO2018/198300
PCT Pub. Date: Jan. 11, 2018

(65) Prior Publication Data

US 2020/0040736 A1 Feb. 6, 2020

(51) Int. Cl.
*F01D 5/14* (2006.01)
*F04D 29/66* (2006.01)

(52) U.S. Cl.
CPC ..... *F01D 5/141* (2013.01); *F04D 29/667* (2013.01); *F05D 2250/70* (2013.01)

(58) Field of Classification Search
CPC ..... F01D 5/141; F04D 29/667; F04D 29/384
See application file for complete search history.

(56) References Cited

U.S. PATENT DOCUMENTS

| | | | |
|---|---|---|---|
| 2003/0012656 | A1 | 1/2003 | Cho et al. |
| 2006/0165526 | A1 | 7/2006 | Cho et al. |
| 2012/0003097 | A1 | 1/2012 | Cho et al. |

FOREIGN PATENT DOCUMENTS

| | | | |
|---|---|---|---|
| CN | 100371607 | C | 2/2008 |
| CN | 101379300 | A | 3/2009 |
| CN | 103140684 | A | 6/2013 |
| CN | 105275854 | A | 1/2016 |
| CN | 205503552 | U | 8/2016 |
| JP | 2015-063912 | A | 4/2015 |
| JP | 2016-166600 | A | 9/2016 |

(Continued)

OTHER PUBLICATIONS

International Search Report dated Jul. 4, 2017 issued in corresponding international patent application No. PCT/JP2017/016878 (and English translation thereof).

(Continued)

*Primary Examiner* — David E Sosnowski
*Assistant Examiner* — Sabbir Hasan
(74) *Attorney, Agent, or Firm* — Posz Law Group, PLC

(57) ABSTRACT

A propeller fan includes a shaft disposed on a rotation axis and a blade disposed adjacent to an outer circumferential surface of the shaft. The blade has a leading edge and a trailing edge. At least one of the leading edge and the trailing edge has a notch. The notch includes a pair of side edge-parts forming an acute included angle and bottom edge-part located between the pair of side edge-parts. The bottom edge-part includes at least one protrusion having an obtuse included angle.

10 Claims, 9 Drawing Sheets

(56) References Cited

FOREIGN PATENT DOCUMENTS

| | | | | | |
|---|---|---|---|---|---|
| JP | 2016166600 | A | * | 9/2016 | ..... F04D 29/384 |
| KR | 10-2013-0109515 | A | | 10/2013 | |
| KR | 20130109515 | A | * | 10/2013 | ..... F04D 29/384 |

OTHER PUBLICATIONS

Extended European Search Report dated Mar. 24, 2020 issued in corresponding European patent application No. 17906931.5.
Examination Report dated May 4, 2020 issued in corresponding AU patent application No. 2017411785.
Office Action dated May 29, 2020 issued in corresponding CN patent application No. 201780089724.X. (with English translation).
Examination Report dated Jul. 28, 2021 issued in corresponding IN patent application No. 201947039645.

* cited by examiner

Comparative Example

PROPELLER FAN

CROSS REFERENCE TO RELATED APPLICATION

This application is a U.S. national stage application of International Application No. PCT/JP2017/016878, filed on Apr. 28, 2017, the contents of which are incorporated herein by reference.

TECHNICAL FIELD

The present invention relates to a propeller fan including a blade having a notch in at least one of a leading edge and a trailing edge of the blade.

BACKGROUND

Patent Literature 1 discloses a fan including blades. Each blade has a sawtooth-like leading edge including multiple tapered projections. Each projection has two sloping outer-edge parts outwardly extending closer to each other and tip-side outer-edge part, serving as the tip of the projection, connecting distal ends of the two sloping outer-edge parts. The two sloping outer-edge parts form an acute angle. The tip-side outer-edge part is shaped to suppress collision between air flows rising up toward a suction surface of the blade. Patent Literature 1 describes that noise can be effectively reduced in the above-described configuration because collision between air flows rising up toward the suction surface of the blade can be reduced near the tip-side outer-edge part of each projection.

PATENT LITERATURE

Patent Literature 1: Japanese Unexamined Patent Application Publication No. 2015-63912

The sawtooth-like leading edge of each blade in Patent Literature 1 includes curved base outer-edge parts each smoothly connecting proximal ends of the sloping outer-edge parts of the two adjacent projections. The two adjacent sloping outer-edge parts on opposite sides of each base outer-edge part form an acute angle. In such a configuration, stress generated by rotation of the blade locally increases in the base outer-edge parts, resulting in a reduction in strength of the blade.

SUMMARY

The present invention has been made to solve the above-described problem, and aims at providing a propeller fan including a blade that exhibits enhanced strength while achieving noise reduction.

A propeller fan according to an embodiment of the present invention includes a shaft disposed on a rotation axis and a blade disposed adjacent to an outer circumferential surface of the shaft. The blade has a leading edge and a trailing edge. At least one of the leading edge and the trailing edge has a notch. The notch includes a pair of side edge-parts forming an acute included angle and bottom edge-part located between the pair of side edge-parts. The bottom edge-part includes at least one first protrusion having an obtuse included angle.

According to the embodiment of the present invention, part of the notch of the blade that is likely to undergo stress concentration can be distributed among the first protrusion and two recesses arranged on opposite sides of the first protrusion. In addition, the obtuse included angle of the protrusion can alleviate an increase in stress in each of the protrusion and the two recesses. Thus, the strength of the blade is enhanced while noise reduction effect achieved by the notch of the blade is maintained.

DETAILED DESCRIPTION

Embodiment 1

Figure 1:
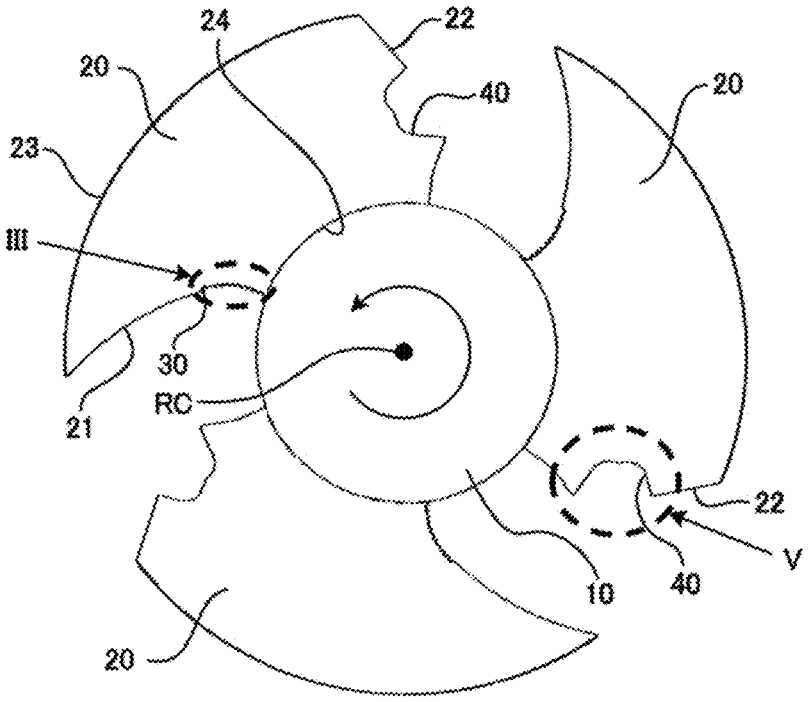
FIG. 1 is a front view of a schematic configuration of a propeller fan according to Embodiment 1 of the present invention.

A propeller fan according to Embodiment 1 of the present invention will be described. The propeller fan is used in, for example, an air-conditioning apparatus or a ventilating apparatus. FIG. 1 is a front view of a schematic configuration of the propeller fan according to Embodiment 1. As illustrated in FIG. 1, the propeller fan includes a boss 10 (an exemplary shaft) that is disposed on a rotation axis RC and rotates about the rotation axis RC and a plurality of flat board-like blades 20 arranged adjacent to an outer circumferential surface of the boss 10. The propeller fan rotates counterclockwise as represented by an arrow in FIG. 1. In FIG. 1, part of the surface of each blade 20 on the front side serves as a suction surface and part thereof on the back side serves as a pressure surface.

Each blade 20 has a leading edge 21, a trailing edge 22, an outer edge 23, and an inner edge 24. The leading edge 21 is an edge part located forward in a rotating direction of the blade 20. The trailing edge 22 is an edge part located backward in the rotating direction of the blade 20. The outer edge 23 is an edge part located in an outer region of the blade 20, or located between an outer end of the leading edge 21 and an outer end of the trailing edge 22. The inner edge 24 is an edge part located in an inner region of the blade 20, or located between an inner end of the leading edge 21 and an inner end of the trailing edge 22. The inner edge 24 is connected to the outer circumferential surface of the boss 10.

At least one of the leading edge 21 and the trailing edge 22 of the blade 20 has at least one notch. The leading edge 21 of the blade 20 has a series of notches 30 arranged adjacent to the inner end of the leading edge 21. In an example illustrated in FIG. 1, about ten notches 30 having the same shape are arranged. This arrangement allows part of the leading edge 21 adjacent to the inner end thereof to have a sawtooth-like shape. The trailing edge 22 of the blade 20 has a notch 40 located in substantially the middle of this edge in a radial direction of the blade. The notch 40 of the trailing edge 22 has a larger width and a larger depth than each of the notches 30 of the leading edge 21. As will be described later, each of the notches 30 and 40 has at least one protrusion protruding from an inner edge of the notch.

Figure 2:
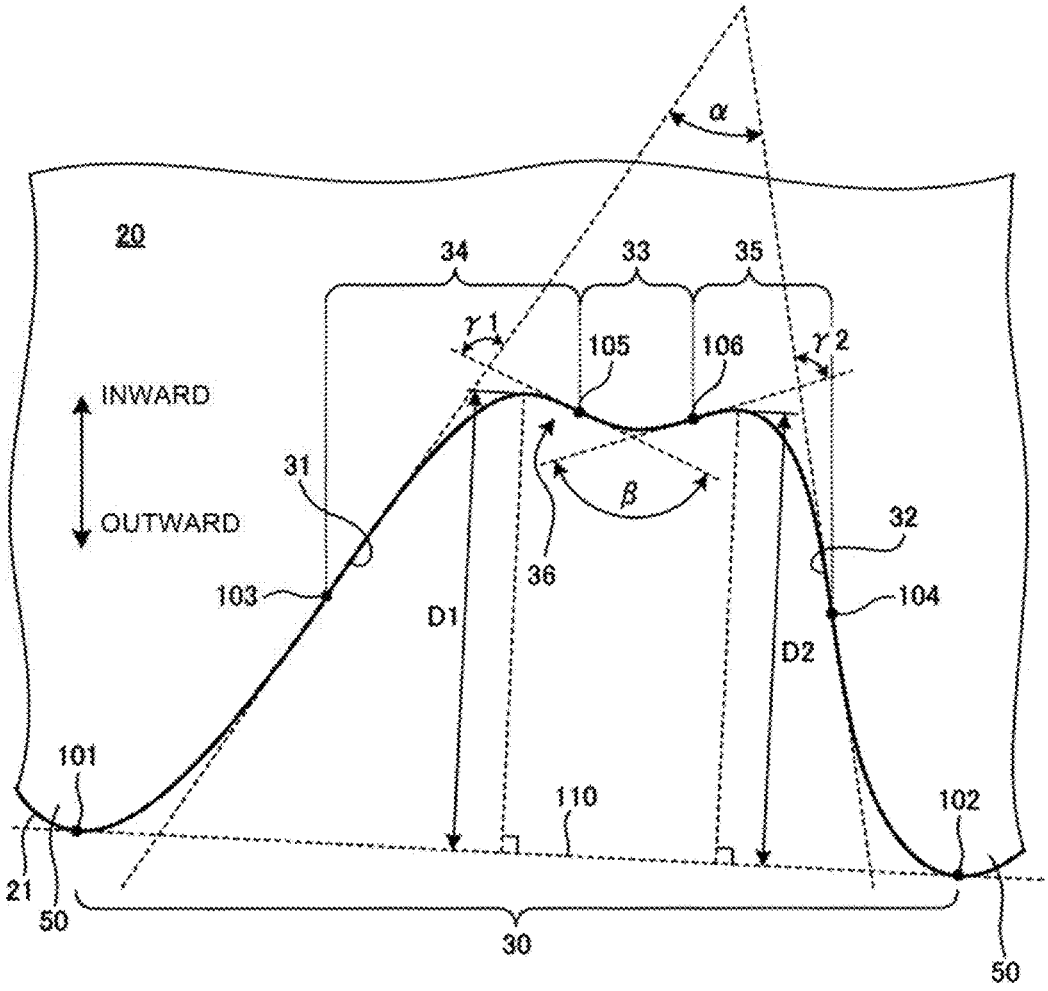
FIG. 2 is an enlarged view of a notch 30 of the propeller fan according to Embodiment 1 of the present invention.

The shapes of the notches 30 and 40 will now be described in detail, using the notch 30 as an example. FIG. 2 is an enlarged view of the notch 30 of the propeller fan according to Embodiment 1. As illustrated in FIG. 2, one notch 30 is located between two adjacent projections 50 each having a relatively large height. More specifically, the notch 30 is located between a top 101 of one projection 50 and a top 102 of the other projection 50. The notch 30 includes a pair of side edge-parts 31 and 32 and bottom edge-part 36 located between the side edge-parts 31 and 32.

The angle formed by one side edge-part 31 and the other side edge-part 32 of the notch 30 is an included angle $\alpha$ (hereinafter, often referred to as an "included angle $\alpha$ of the notch 30") defined between the side edge-part 31 and the side edge-part 32. In a case where the side edge-parts 31 and 32 are curves, the included angle $\alpha$ between the side edge-parts 31 and 32 is the angle formed by a tangent to the side edge-part 31 at an inflection point 103 thereof and a tangent to the side edge-part 32 at an inflection point 104 thereof. The notch 30 decreases in width inwardly or farther away from the edge, or upwardly in FIG. 2, or increases in width outwardly or toward the edge, or downwardly in FIG. 2. The included angle $\alpha$ of the notch 30 is an acute angle (0 degrees$<\alpha<$90 degrees).

The bottom edge-part 36 of the notch 30 includes a protrusion 33 (an exemplary first protrusion) protruding outward, or toward the edge. Two recesses 34 and 35 extending inward, or farther away from the edge, are arranged on opposite sides of the protrusion 33. The recess 34 overlaps the bottom edge-part 36 and the side edge-part 31. The recess 35 overlaps the bottom edge-part 36 and the side edge-part 32. The angle formed by a tangent to a part between the protrusion 33 and the recess 34 at an inflection point 105 and a tangent to a part between the protrusion 33 and the recess 35 at an inflection point 106 is an included angle $\beta$ of the protrusion 33. The included angle $\beta$ of the protrusion 33 is an obtuse angle (90 degrees$<\beta<$180 degrees). The protrusion 33 includes one or more arcs. Each of the recesses 34 and 35 includes one or more arcs.

The angle formed by the tangent at the inflection point 103 and the tangent at the inflection point 105 is an included angle $\gamma$1 of the recess 34. The angle formed by the tangent at the inflection point 104 and the tangent at the inflection point 106 is an included angle $\gamma$2 of the recess 35. It is preferred that at least one of the included angle $\gamma$1 and the included angle $\gamma$2 be an obtuse angle. In an example illustrated in FIG. 2, the included angle $\gamma$1 of the recess 34 is an obtuse angle and the included angle $\gamma$2 of the recess 35 is an acute angle.

In a direction perpendicular to a straight line 110 passing through the tops 101 and 102 (for example, a tangent to the two adjacent projections 50), a maximum distance between the straight line 110 and the recess 34 corresponds to a depth D1 of the recess 34. Similarly, in the direction perpendicular to the straight line 110, a maximum distance between the straight line 110 and the recess 35 corresponds to a depth D2 of the recess 35. The depth D1 and the depth D2 may be the same as or may differ from each other. The protrusion 33 does not touch or cross the straight line 110 because the protrusion 33 is lower than the projections 50.

For example, the protrusion 33 is located in the middle part of the notch 30 in the radial direction of the blade 20. Specifically, when the distance between the top 101, serving as an outer end of the notch 30, and the rotation axis RC is referred to as r1 and when the distance between the top 102, serving as an inner end of the notch 30, and the rotation axis RC is referred to as r2, a circle having its center at the rotation axis RC and a radius (r1+r2)/2 overlaps the protrusion 33. Consequently, part of the protrusion 33 is located within the circle and the other part of the protrusion 33 is located outside the circle. As described above, it is preferred that at least part of the protrusion 33 included in the notch 30 be located in each of the inside and the outside of the above-described circle. If the notch 30 includes a plurality of protrusions, it is preferred that at least subset of the plurality of protrusions be located in both the inside and the outside of the above-described circle.

Figure 3:
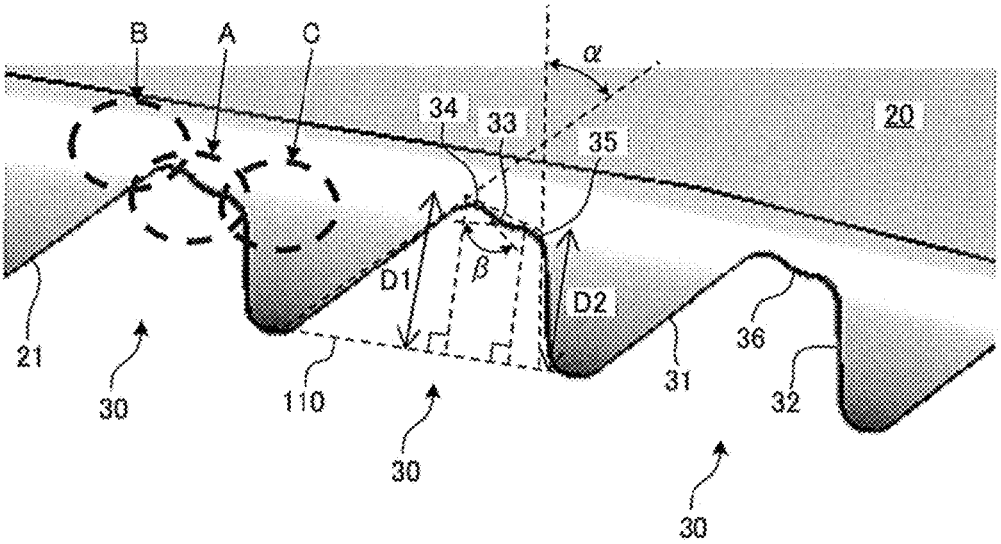
FIG. 3 is a partial enlarged view of part III in FIG. 1.

FIG. 3 is a partial enlarged view of part III in FIG. 1. As illustrated in FIG. 3, the included angle $\alpha$ of each notch 30 is an acute angle. The bottom edge-part 36 of the notch 30 includes one protrusion 33. Two recesses 34 and 35 are arranged on opposite sides of the protrusion 33. The included angle $\beta$ of the protrusion 33 is an obtuse angle. The depth D1 of the recess 34 is larger than the depth D2 of the recess 35 (D1>D2).

Figure 4:
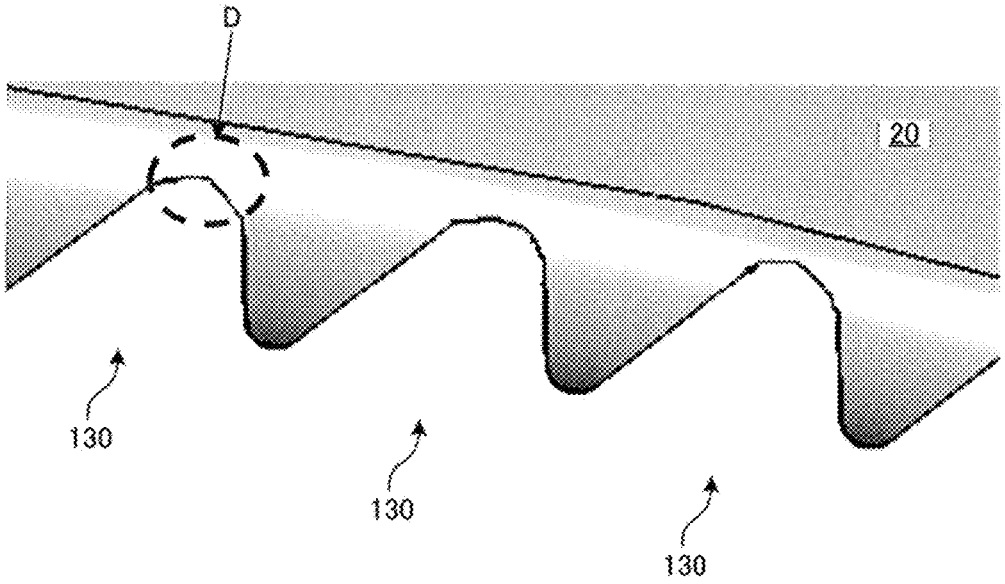
FIG. 4 is an enlarged view of part of a leading edge of a propeller fan according to Comparative Example.

FIG. 4 is an enlarged view of a part of a leading edge of a propeller fan according to Comparative Example. Like the notches 30 in Embodiment 1 illustrated in FIG. 3, notches 130 in Comparative Example of FIG. 4 have an acute included angle. In a configuration in Comparative Example, the notches 130 allow air flow distribution and vortex distribution and thus enable a vortex, serving as a noise source, to be divided into fragments. Therefore, the configuration in Comparative Example can reduce noise in the propeller fan and improve the efficiency of the propeller fan. Unlike the notches 30 in Embodiment 1, however, each of the notches 130 in Comparative Example does not include a protrusion protruding from its bottom edge-part. In the configuration in Comparative Example, stress generated by rotation of the blade 20 increases locally in the bottom edge-part (for example, part D in FIG. 4) of each notch 130, so that the blade 20 may decrease in strength.

In contrast, the bottom edge-part 36 of each notch 30 in Embodiment 1 illustrated in FIG. 3 includes the protrusion 33 having the obtuse included angle $\beta$. In addition, the two recesses 34 and 35 are arranged on the opposite sides of the protrusion 33. The configuration in Embodiment 1 allows a part that is likely to undergo stress concentration to be distributed among multiple locations including part A near the protrusion 33, part B near the recess 34, and part C near the recess 35. In addition, the obtuse included angle $\beta$ of the protrusion 33 can alleviate an increase in stress in each of the parts A, B, and C. This prevents stress produced by rotation of the blade 20 from increasing locally, thereby alleviating stress concentration. According to Embodiment 1, therefore, the strength of the blade 20 is enhanced while the effect of reducing noise in the propeller fan and the effect of improving the efficiency of the propeller fan achieved by the notches 30 are maintained.

Figure 5:
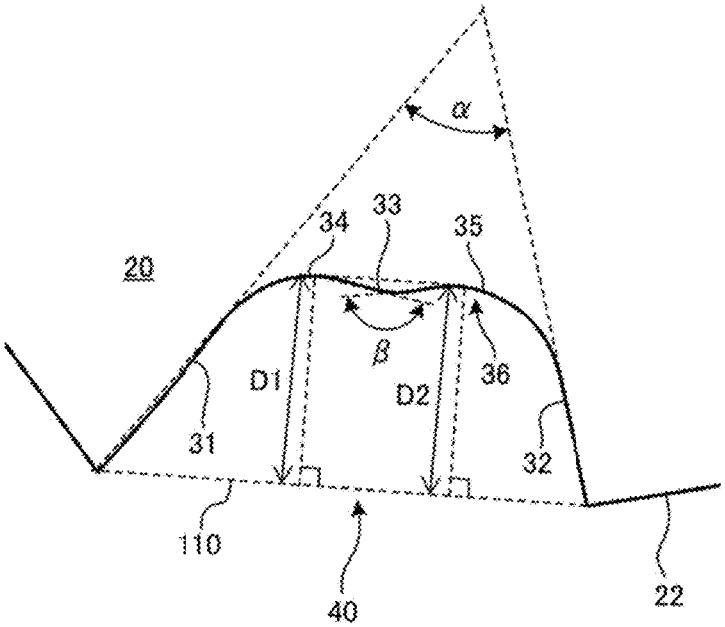
FIG. 5 is an enlarged view of part V in FIG. 1.

FIG. 5 is an enlarged view of part V in FIG. 1. As illustrated in FIG. 5, the included angle α of the notch 40 is an acute angle. The bottom edge-part 36 of the notch 40 includes one protrusion 33. The included angle β of the protrusion 33 is an obtuse angle. Two recesses 34 and 35 are arranged on opposite sides of the protrusion 33. The depth D1 of the recess 34 and the depth D2 of the recess 35 are the same (D1=D2). Like the shape of the notches 30 illustrated in FIG. 3, such a shape of the notch 40 allows a part that is likely to undergo stress concentration to be distributed among multiple locations. Therefore, the strength of the blade 20 is enhanced while the effect of reducing noise in the propeller fan and the effect of improving the efficiency of the propeller fan achieved by the notch 40 are maintained.

As described above, the propeller fan according to Embodiment 1 includes the boss 10 (exemplary shaft) disposed on the rotation axis RC and the blades 20 each having the leading edge 21 and the trailing edge 22 and arranged adjacent to the outer circumferential surface of the boss 10. At least one of the leading edge 21 and the trailing edge 22 has a notch 30 or a notch 40. The notch 30 or the notch 40 includes the pair of side edge-parts 31 and 32 forming an acute included angle α and the bottom edge-part 36 located between the pair of side edge-parts 31 and 32. The bottom edge-part 36 includes at least one protrusion 33 (exemplary first protrusion) having an obtuse included angle β.

This configuration allows a part of the notch 30 or the notch 40 that is likely to undergo stress concentration to be distributed among the protrusion 33 and the two recesses 34 and 35 arranged on the opposite sides of the protrusion 33. In addition, the obtuse included angle β of the protrusion 33 can alleviate an increase in stress in each of the protrusion 33 and the two recesses 34 and 35. Thus, the strength of the blade 20 is enhanced while the effect of reducing noise in the propeller fan and the effect of improving the efficiency of the propeller fan achieved by the notch 30 or 40 of the blade 20 are maintained.

In the propeller fan according to Embodiment 1, the protrusion 33 is located in the middle part of the notch 30 or the notch 40 in the radial direction of the blade 20. This configuration more effectively allows distribution of part of the notch 30 or the notch 40 that is likely to undergo stress concentration, thus further enhancing the strength of the blade 20.

In the propeller fan according to Embodiment 1, the protrusion 33 includes one or more arcs. This configuration can alleviate an increase in stress in the protrusion 33, thus further enhancing the strength of the blade 20.

In the propeller fan according to Embodiment 1, the notch 30 or the notch 40 includes the two recesses 34 and 35 arranged on the opposite sides of the protrusion 33. The included angle of at least one of the two recesses 34 and 35 (for example, the included angle γ1 of the recess 34) is an obtuse angle. This configuration can alleviate an increase in stress in at least one of the recesses 34 and 35, thus further enhancing the strength of the blade 20.

Embodiment 2

Figure 6:
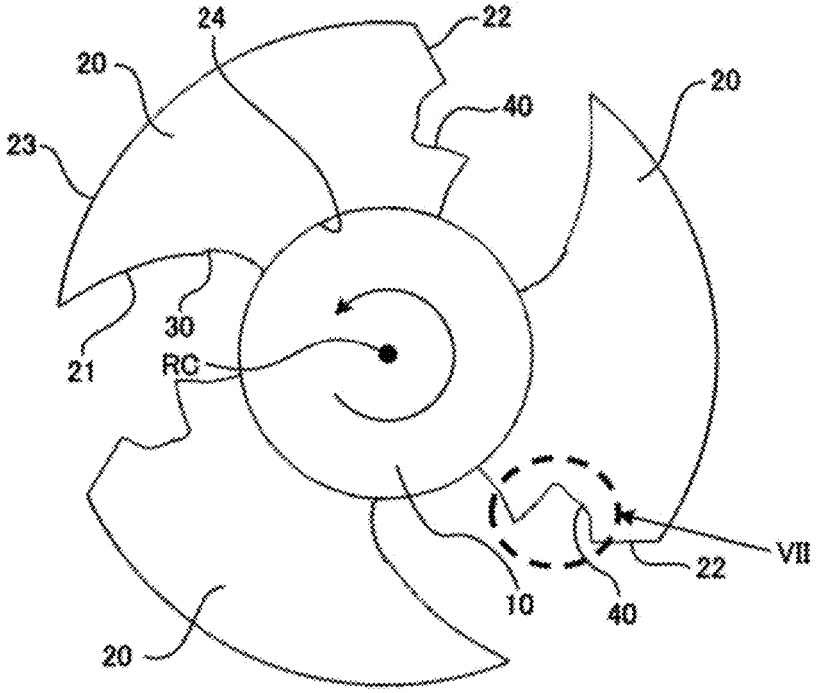
FIG. 6 is a front view of a schematic configuration of a propeller fan according to Embodiment 2 of the present invention.
Figure 7:
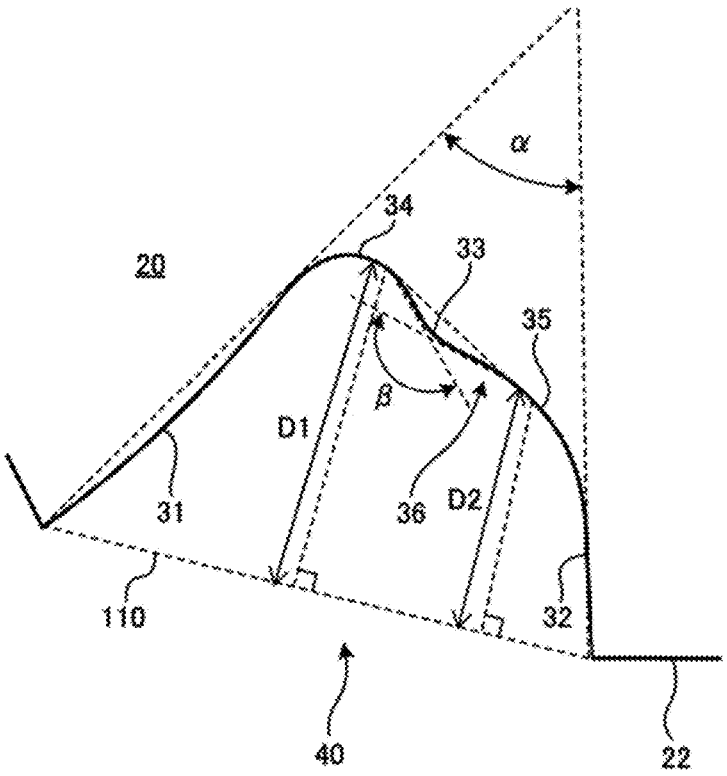
FIG. 7 is an enlarged view of part VII in FIG. 6.

A propeller fan according to Embodiment 2 of the present invention will be described. FIG. 6 is a front view of a schematic configuration of the propeller fan according to Embodiment 2. FIG. 7 is an enlarged view of part VII in FIG. 6. The propeller fan according to Embodiment 2 differs from that according to Embodiment 1 in the shape of each notch 40. Elements having the same functions and effects as those in Embodiment 1 are designated by the same reference signs and a description of these elements is omitted.

For the recesses 34 and 35 of each notch 40 in Embodiment 2, as illustrated in FIGS. 6 and 7, the depth D1 of the recess 34 adjacent to the inner edge of the blade 20 is larger than the depth D2 of the recess 35 adjacent to the outer edge of the blade 20 (D1>D2). As in Embodiment 1, the included angle α of the notch 40 is an acute angle and the included angle β of the protrusion 33 is an obtuse angle. Embodiment 2 offers the same advantageous effects as those in Embodiment 1.

Embodiment 3

Figure 8:
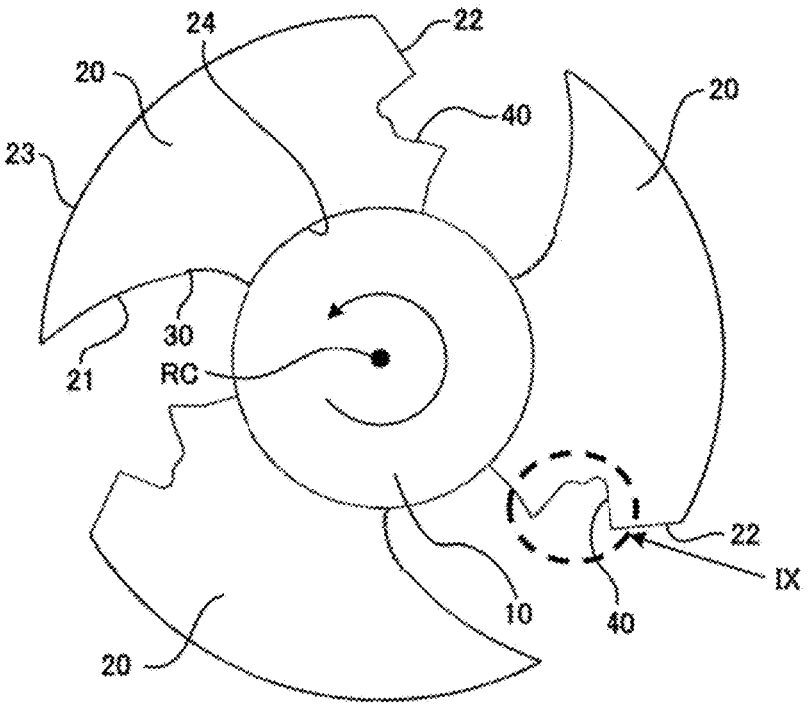
FIG. 8 is a front view of a schematic configuration of a propeller fan according to Embodiment 3 of the present invention.
Figure 9:
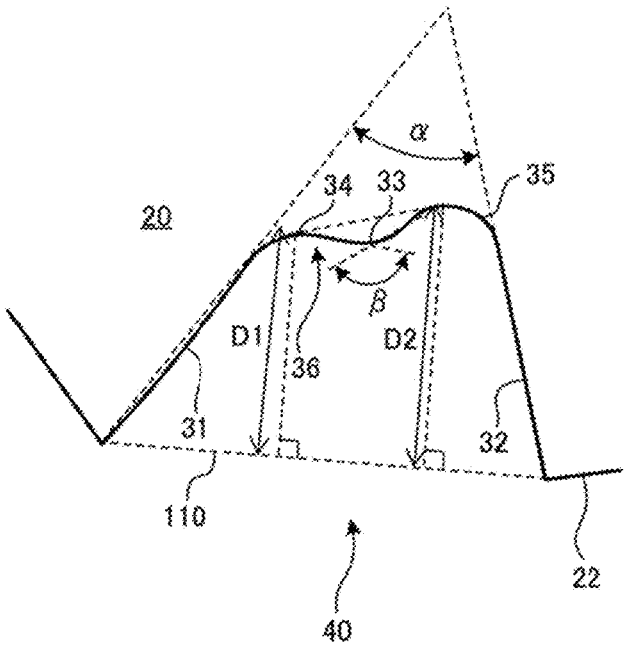
FIG. 9 is an enlarged view of part IX in FIG. 8.

A propeller fan according to Embodiment 3 of the present invention will be described. FIG. 8 is a front view of a schematic configuration of the propeller fan according to Embodiment 3. FIG. 9 is an enlarged view of part IX in FIG. 8. Elements having the same functions and effects as those in Embodiment 1 are designated by the same reference signs and a description of these elements is omitted.

For the recesses 34 and 35 of each notch 40 in Embodiment 3, as illustrated in FIGS. 8 and 9, the depth D1 of the recess 34 adjacent to the inner edge of the blade 20 is smaller than the depth D2 of the recess 35 adjacent to the outer edge of the blade 20 (D1<D2). As in Embodiment 1, the included angle α of the notch 40 is an acute angle and the included angle β of the protrusion 33 is an obtuse angle. Embodiment 3 offers the same advantageous effects as those in Embodiment 1.

Embodiment 4

Figure 10:
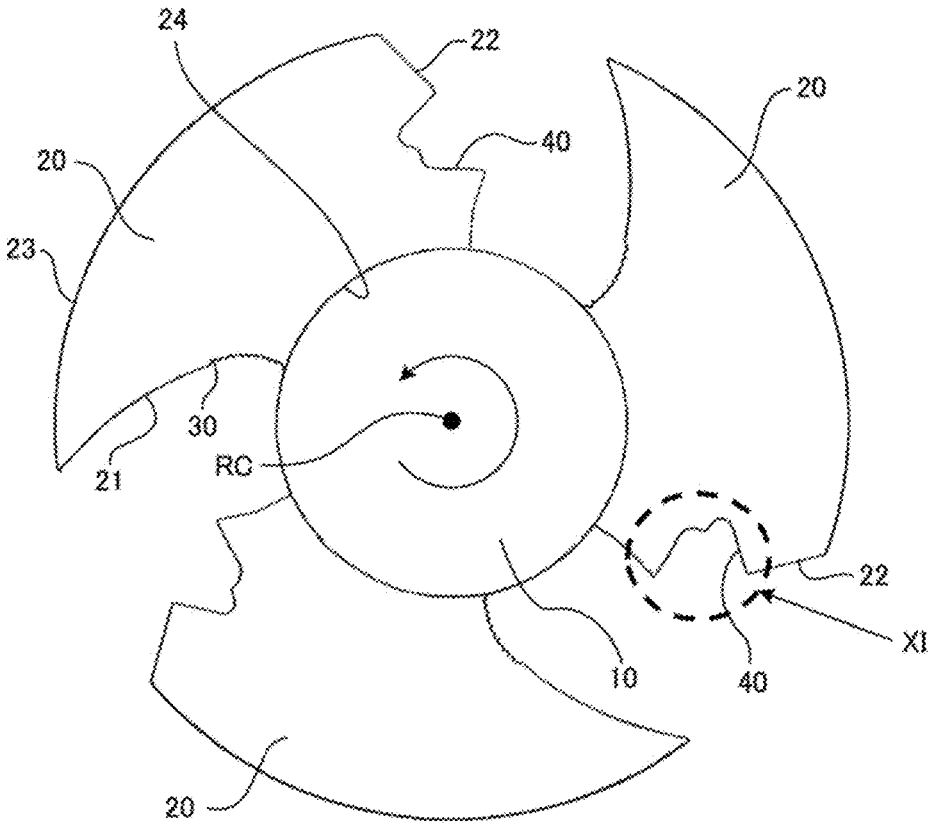
FIG. 10 is a front view of a schematic configuration of a propeller fan according to Embodiment 4 of the present invention.
Figure 11:
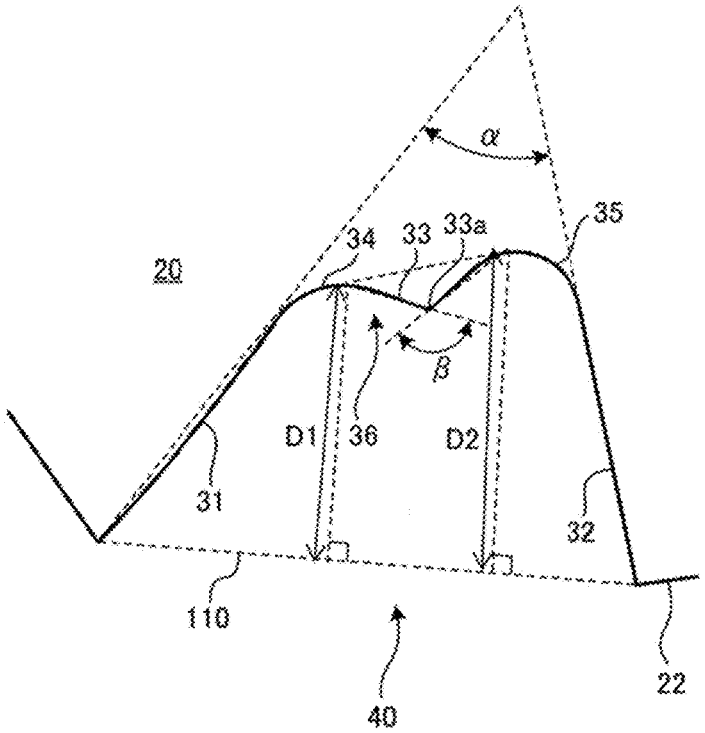
FIG. 11 is an enlarged view of part XI in FIG. 10.

A propeller fan according to Embodiment 4 of the present invention will be described. FIG. 10 is a front view of a schematic configuration of the propeller fan according to Embodiment 4. FIG. 11 is an enlarged view of part XI in FIG. 10. Elements having the same functions and effects as those in Embodiment 1 or 3 are designated by the same reference signs and a description of these elements is omitted.

As illustrated in FIGS. 10 and 11, each protrusion 33 in Embodiment 4 is triangular and thus has a pointed tip 33*a*. The rest of the configuration is the same as that in Embodiment 3. The pointed tip 33*a* of the protrusion 33 promotes air flow distribution and vortex distribution in the notch 40. Consequently, a vortex, serving as a noise source, can be more effectively divided into fragments. Such a configuration in Embodiment 4, therefore, achieves a further reduction in noise in the propeller fan and further improvement of the efficiency of the propeller fan.

Embodiment 5

Figure 12:
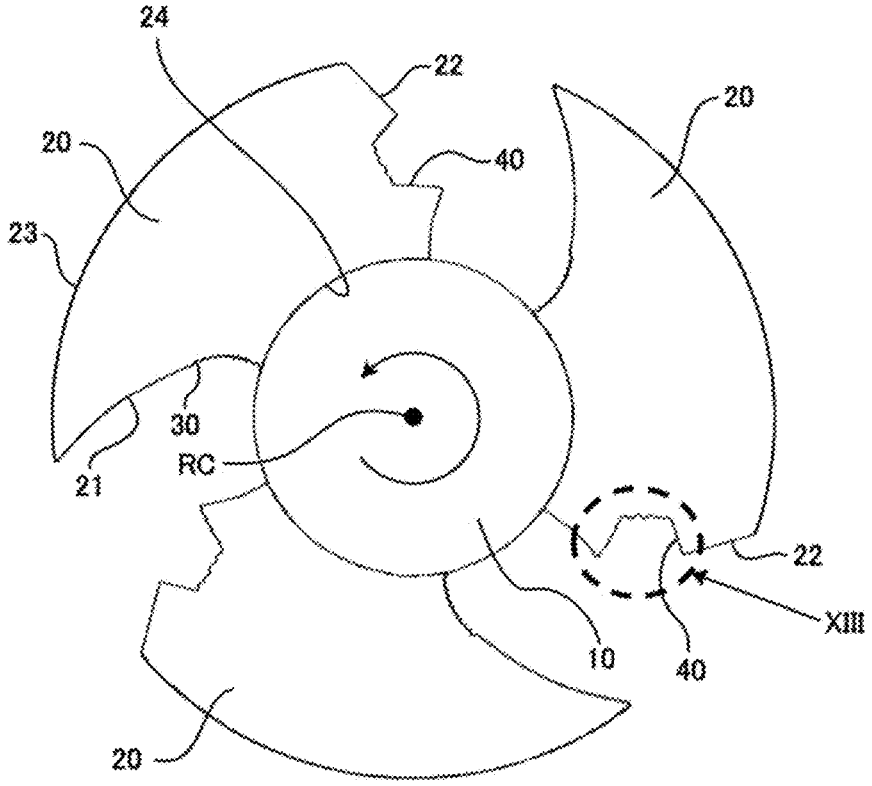
FIG. 12 is a front view of a schematic configuration of a propeller fan according to Embodiment 5 of the present invention.
Figure 13:
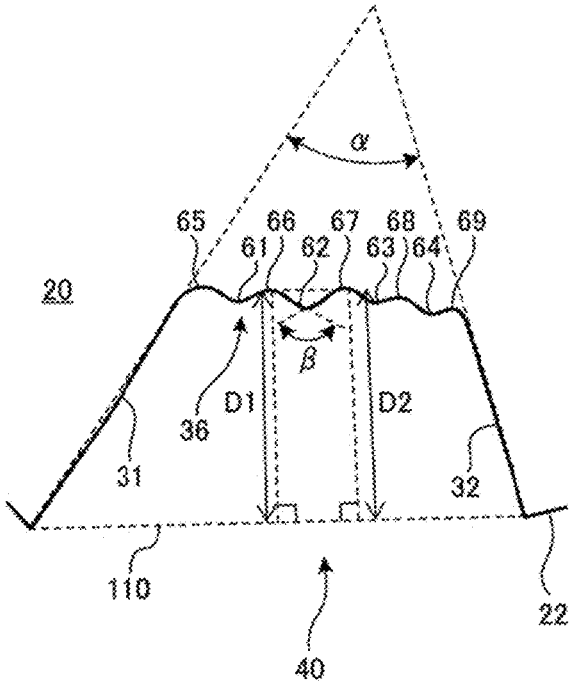
FIG. 13 is an enlarged view of part XIII in FIG. 12.

A propeller fan according to Embodiment 5 of the present invention will be described. FIG. 12 is a front view of a schematic configuration of the propeller fan according to Embodiment 5. FIG. 13 is an enlarged view of part XIII in FIG. 12. Elements having the same functions and effects as those in Embodiment 1 are designated by the same reference signs and a description of these elements is avoided.

As illustrated in FIGS. 12 and 13, the bottom edge-part 36 of each notch 40 in Embodiment 5 includes protrusions 61, 62, 63, and 64 (exemplary first protrusions) and recesses 65, 66, 67, 68, and 69 such that the protrusions and the recesses are alternately arranged along the bottom edge-part 36. The included angle β of each of the protrusions 61, 62, 63, and 64 is an obtuse angle. The recesses 65, 66, 67, 68, and 69 may have the same depth or may have different depths.

As described above, the propeller fan according to Embodiment 5 is configured such that the bottom edge-part 36 includes the protrusions 61, 62, 63, and 64 (exemplary first protrusions). Such a configuration allows a part that is likely to undergo stress concentration to be distributed among more locations, thus further enhancing the strength of the blade 20.

Embodiment 6

Figure 14:
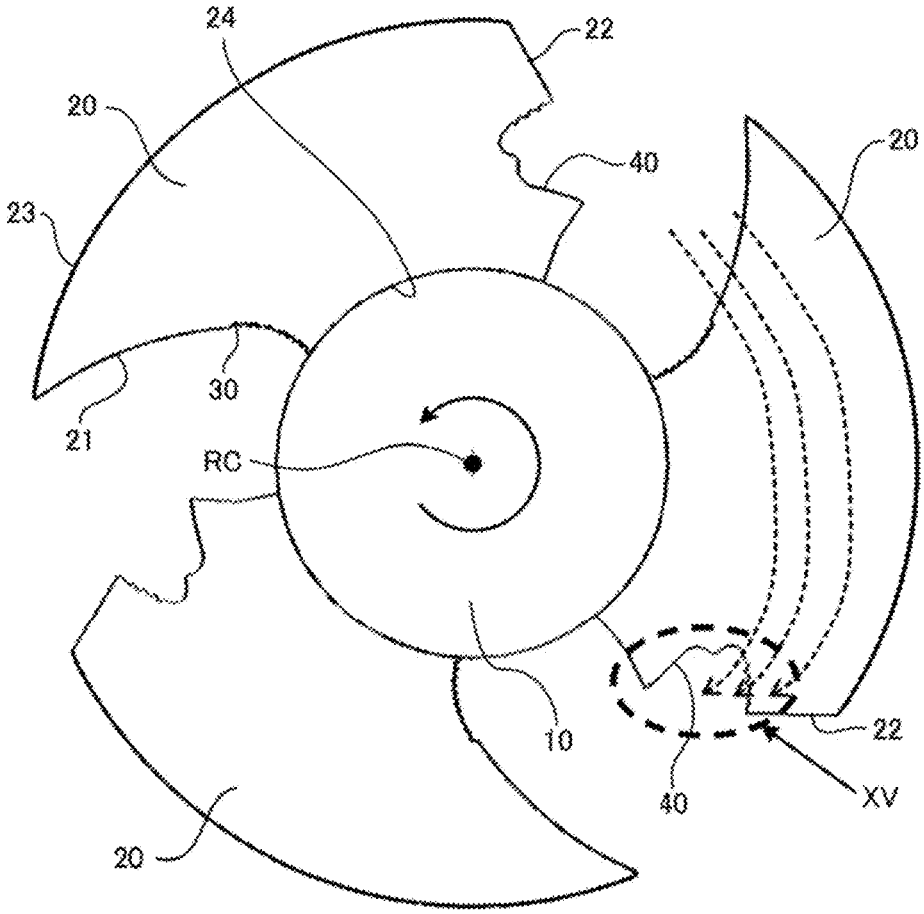
FIG. 14 is a front view of a schematic configuration of a propeller fan according to Embodiment 6 of the present invention.
Figure 15:
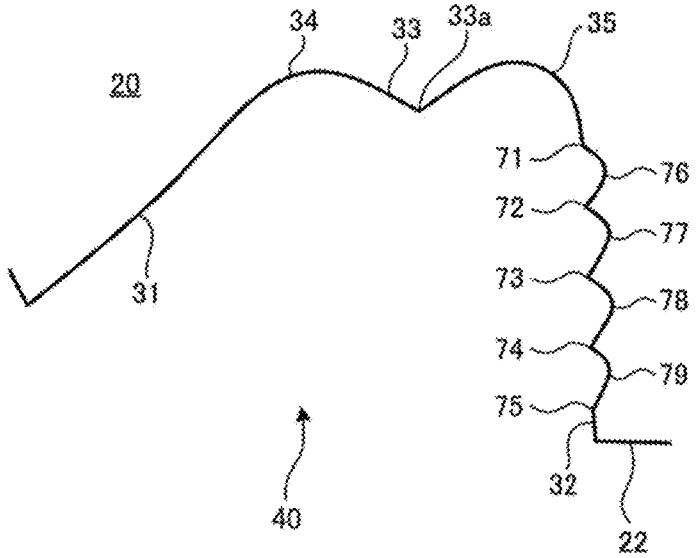
FIG. 15 is an enlarged view of part XV in FIG. 14.

A propeller fan according to Embodiment 6 of the present invention will be described. FIG. 14 is a front view of a schematic configuration of the propeller fan according to Embodiment 6. FIG. 15 is an enlarged view of part XV in FIG. 14. Elements having the same functions and effects as those in Embodiment 1 or 4 are designated by the same reference signs and a description of these elements is avoided.

For the side edge-parts 31 and 32 of each notch 40, as illustrated in FIGS. 14 and 15, the side edge-part 32 adjacent to an outer circumference of the propeller fan includes protrusions 71, 72, 73, 74, and 75 (exemplary second protrusions) and recesses 76, 77, 78, and 79 such that the protrusions and the recesses are alternately arranged along the side edge-part 32. The rest of the configuration is the same as that in Embodiment 4.

In Embodiment 6, when air flows, represented by dashed lines in FIG. 14, concentrate in the side edge-part 32 of the notch 40 adjacent to the outer circumference, the protrusions 71, 72, 73, 74, and 75 can distribute a large separating flow that occurs in the side edge-part 32. This leads to improved aerodynamic performance of the blade 20. Although the included angle of each of the protrusions 71, 72, 73, 74, and 75 is an obtuse angle in Embodiment 6, the included angle of each of the protrusions 71, 72, 73, 74, and 75 may be an acute angle or a right angle because the side edge-part 32 is unlikely to undergo stress concentration.

For the pair of side edge-parts 31 and 32 in the propeller fan according to Embodiment 6, as described above, the side edge-part 32 located adjacent to the outer circumference of the propeller fan includes the protrusions 71, 72, 73, 74, and 75 (exemplary second protrusions). This configuration improves the aerodynamic performance of the blade 20, thus further reducing noise in the propeller fan and further improving the efficiency of the propeller fan.

Embodiment 7

Figure 16:
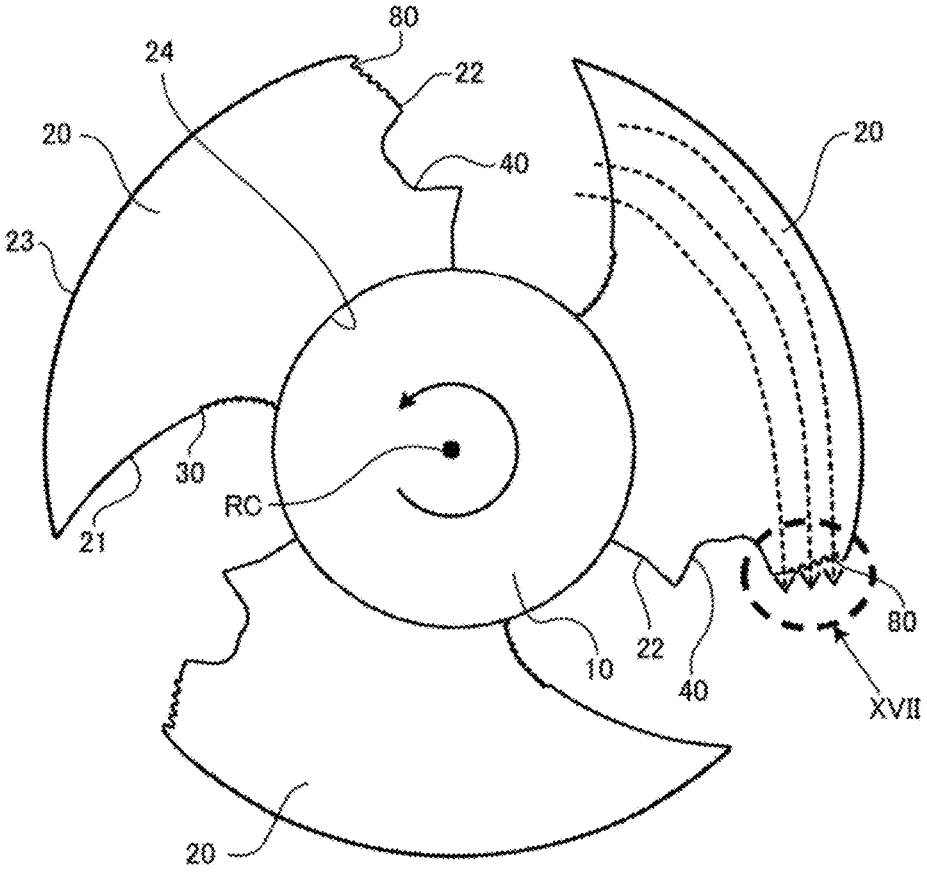
FIG. 16 is a front view of a schematic configuration of a propeller fan according to Embodiment 7 of the present invention.
Figure 17:
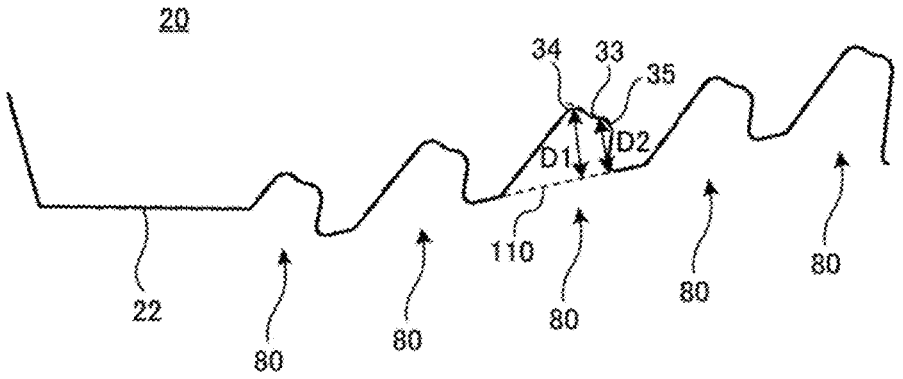
FIG. 17 is an enlarged view of part XVII in FIG. 16.

A propeller fan according to Embodiment 7 of the present invention will be described. FIG. 16 is a front view of a schematic configuration of the propeller fan according to Embodiment 7. FIG. 17 is an enlarged view of part XVII in FIG. 16. Elements having the same functions and effects as those in Embodiment 1 are designated by the same reference signs and a description of these elements is avoided.

As illustrated in FIGS. 16 and 17, part that is included in the trailing edge 22 of each blade 20 and that is located closer to the outer edge of the blade 20 than the notch 40 slopes toward the outer edge and forward in the rotating direction. This part, which is included in the trailing edge 22 of the blade 20 and is located closer to the outer edge than the notch 40, includes a plurality of notches 80. Each notch 80 in Embodiment 7 has a smaller width and a smaller depth than the notch 40, and has a larger width and a larger depth than the notch 30 in the leading edge 21. For the recesses 34 and 35 of the notch 80, the depth D1 of the recess 34 adjacent to the inner edge of the blade 20 is larger than the depth D2 of the recess 35 adjacent to the outer edge of the blade 20 (D1>D2). Consequently, the recesses 34 and 35 are allowed to have the same orientation relative to air flows, represented by dashed lines in FIG. 16, on the blade, thus further regulating a separating flow. This leads to improved aerodynamic performance of the blade 20, thus further reducing noise in the propeller fan and further improving the efficiency of the propeller fan.

Embodiments 1 to 7 can be combined and implemented.

The invention claimed is:

1. A propeller fan comprising:

a shaft disposed on a rotation axis; and a blade disposed adjacent to an outer circumferential surface of the shaft, the blade having a leading edge and a trailing edge, wherein at least one of the leading edge and the trailing edge has a notch that extends from respective tops of two adjacent projections, a first radial distance of the at least one of the leading edge and the trailing edge occupied by the notch is less than a second radial distance of the at least one of the leading edge and the trailing edge which is unoccupied by the notch, wherein the notch includes a pair of side edge-parts forming an acute included angle and a bottom edge-part located between the pair of side edge-parts, wherein the bottom edge-part includes at least one first protrusion having an obtuse included angle, and wherein the at least one first protrusion is located in a middle part of the notch in a radial direction of the blade.

2. The propeller fan of claim 1, wherein the at least one first protrusion includes one or more arcs.

3. The propeller fan of claim 1, wherein the notch includes, for each protrusion of the at least one first protrusion, two recesses arranged on opposite sides of the each protrusion of the at least one first protrusion, and wherein at least one of the two recesses has an obtuse included angle.

4. The propeller fan of claim 1, wherein the at least one first protrusion of the bottom edge-part comprises a plurality of first protrusions.

5. The propeller fan of claim 1, wherein the at least one first protrusion in the notch is lower than the two adjacent projections and does not touch or cross a straight line between the respective tops of the two adjacent projections.

6. A propeller fan comprising:

a shaft disposed on a rotation axis; and a blade disposed adjacent to an outer circumferential surface of the shaft, the blade having a leading edge and a trailing edge, wherein at least one of the leading edge and the trailing edge has a notch that extends from respective tops of two adjacent projections, a first radial distance of the at least one of the leading edge and the trailing edge occupied by the notch is less than a second radial distance of the at least one of the leading edge and the trailing edge which is unoccupied by the notch, wherein the notch includes a pair of side edge-parts forming an acute included angle and a bottom edge-part located between the pair of side edge-parts, wherein the bottom edge-part includes at least one first protrusion having an obtuse included angle, and wherein one of the pair of side edge-parts is located adjacent to an outer circumference of the propeller fan and includes a second protrusion.

7. The propeller fan of claim 6, wherein the at least one first protrusion includes one or more arcs.

8. The propeller fan of claim 6, wherein the notch includes, for each protrusion of the at least one first protrusion, two recesses arranged on opposite sides of the each protrusion of the at least one first protrusion, and wherein at least one of the two recesses has an obtuse included angle.

9. The propeller fan of claim 6, wherein the at least one first protrusion of the bottom edge-part comprises a plurality of first protrusions.

10. The propeller fan of claim 6, wherein the at least one first protrusion in the notch is lower than the two adjacent projections and does not touch or cross a straight line between the respective tops of the two adjacent projections.

* * * * *